US006923447B2

(12) United States Patent
Lai

(10) Patent No.: US 6,923,447 B2
(45) Date of Patent: Aug. 2, 2005

(54) ELECTRONIC DARTBOARD ADAPTED TO METAL DART

(76) Inventor: Shu-Mu Lai, No. 21-7, Lane Juangnei, Beituen Chiu, Taichung (TW)

( * ) Notice: Subject to any disclaimer, the term of this patent is extended or adjusted under 35 U.S.C. 154(b) by 1 day.

(21) Appl. No.: 10/699,214

(22) Filed: Oct. 31, 2003

(65) Prior Publication Data

US 2005/0093242 A1 May 5, 2005

(51) Int. Cl.[7] ..... A63B 5/04
(52) U.S. Cl. ..... 273/376
(58) Field of Search ..... 273/374, 376, 273/403, 408

(56) References Cited

U.S. PATENT DOCUMENTS 4,561,660 A * 12/1985 Zammuto ..... 273/376
5,560,617 A * 10/1996 Liang ..... 273/376
5,648,752 A * 7/1997 Alfrey ..... 340/323 R
5,788,244 A * 8/1998 Hui et al. ..... 273/374
6,047,968 A * 4/2000 Lu et al. ..... 273/371
6,089,571 A * 7/2000 Cho ..... 273/371
6,116,607 A * 9/2000 Cho ..... 273/371
6,394,458 B2 * 5/2002 Chang ..... 273/376
6,659,465 B2 * 12/2003 Yiu ..... 273/374
2002/0063390 A1 * 5/2002 Cho ..... 273/408
2002/0163131 A1 * 11/2002 Yiu ..... 273/374
2002/0171203 A1 * 11/2002 Cho ..... 273/374
2003/0214098 A1 * 11/2003 Chang ..... 273/408

* cited by examiner

*Primary Examiner*—Mark S. Graham
(74) *Attorney, Agent, or Firm*—W. Wayne Liauh

(57) ABSTRACT

An electronic dartboard comprises a dartboard frame in which a plurality of dartboard blocks are disposed. The dartboard blocks are formed of a dartboard body and a mounting seat in which the dartboard body is movably disposed. The dartboard frame is mounted in an outer frame which is provided with a score board and a circuit board. The dartboard frame is provided in the front with a plurality of protective frames, and in the back with an induction circuit film set. A cover plate is provided with a plurality of silencing holes and is fastened with the outer frame. A score display is separably connected to the circuit board.

7 Claims, 15 Drawing Sheets

ELECTRONIC DARTBOARD ADAPTED TO METAL DART

FIELD OF THE INVENTION

The present invention relates generally to an electronic dartboard, and more particularly to an electronic dartboard which is made suitable for use with a metal dart.

BACKGROUND OF THE INVENTION

As shown in FIGS. 1 and 2, an electronic dartboard of the prior art comprises a board frame 2, a plurality of board blocks 3, an induction circuit film set 4, a locating plate 5, a board frame seat 6, and a score display 7 mounted on the board frame seat 6. In operation, as a metal dart hits a board block 3, a score signal is transmitted to the score display 7 via the induction circuit film set 4. When the board block 3 is hit, the induction circuit film set 4 is impacted to collide with the locating plate 5, thereby resulting in noise. In light of the dartboard being a closed structure, the noise can not be dissipated. As a result, the prior art electronic dartboard in operation is annoyingly noisy. In addition, the score display 7 is located in the lower portion of the dartboard and is therefore vulnerable to damage which is caused by a misfired metal dart.

As shown in FIG. 3, a dartboard block structure of the Taiwan Patent Serial No. 89222453 comprises a board block 8 which is formed of a board body 9 and a frame 10. The body body 9 is made of sisal. The frame 10 has a confining wall 11. In assembly, the board body 9 is first manually compressed and then inserted into the frame 10. Upon having been located inside the frame 10, the board body 9 expands to press against the confining wall 11 of the frame 10. In the event that the expansion of the board body 9 is excessive, the frame 10 and the board body 9 are associated with an excessive tightness. On the contrary, if the expansion of the board body 9 is less than what is expected, the frame 10 and the board body 9 are likely to associate with each other with an excessive looseness. Under such circumstances as described above, the board block 8 is likely to function with imprecision.

The conventional dartboard frame is generally made of a plastic material and is provided with a metal protective frame. Technically speaking, the protective frame can not be made integrally by injection molding. In order to overcome such a technical problem as described above, the Taiwan Patent Serial No. 90221325 discloses a dartboard protective structure, as shown in FIG. 4 in which a dartboard frame 12 is provided with a plurality of frame supports 13 and retaining slots 14 located at the junctures of the frame supports 13. A plurality of protective pieces 15 are mounted on the frame supports 13 in conjunction with a plurality of locating members 16 which are retained by the retaining slots 14. The mounting of the protective pieces 15 is a time-consuming chore. In addition, the use of the protective member 16 gives an added cost to the production of the conventional dartboard.

SUMMARY OF THE INVENTION

The primary objective of the present invention is to provide an electronic dartboard comprising a frame and a plurality of dartboard blocks, each being formed of a dartboard body and a mounting seat. The dartboard body is made of a composite material and is associated with the frame with an appropriate tightness, thereby enabling the dartboard body to engage in a microdisplacement. As the dartboard blocks are hit by the darts, the mounting seat is caused to vibrate via the dartboard body, thereby resulting in activation of the induction circuit film set. The mounting seat and the cover plate of the electronic dartboard are provided with a number of silencing holes by means of which the electronic dartboard of the present invention works quietly.

It is another objective of the present invention to provide an electronic dartboard with an independent score display which is connected to the electronic dartboard by a transmission line.

It is still another objective of the present invention to provide an electronic dartboard with a protective frame which is fastened to the frame of the electronic dartboard by a mortise-tenon mechanism.

The features and the advantages of the present invention will be more readily understood upon a thoughtful deliberation of the following detailed description of the present invention with reference to the accompanying drawings.

DETAILED DESCRIPTION OF THE INVENTION

Figure 1:
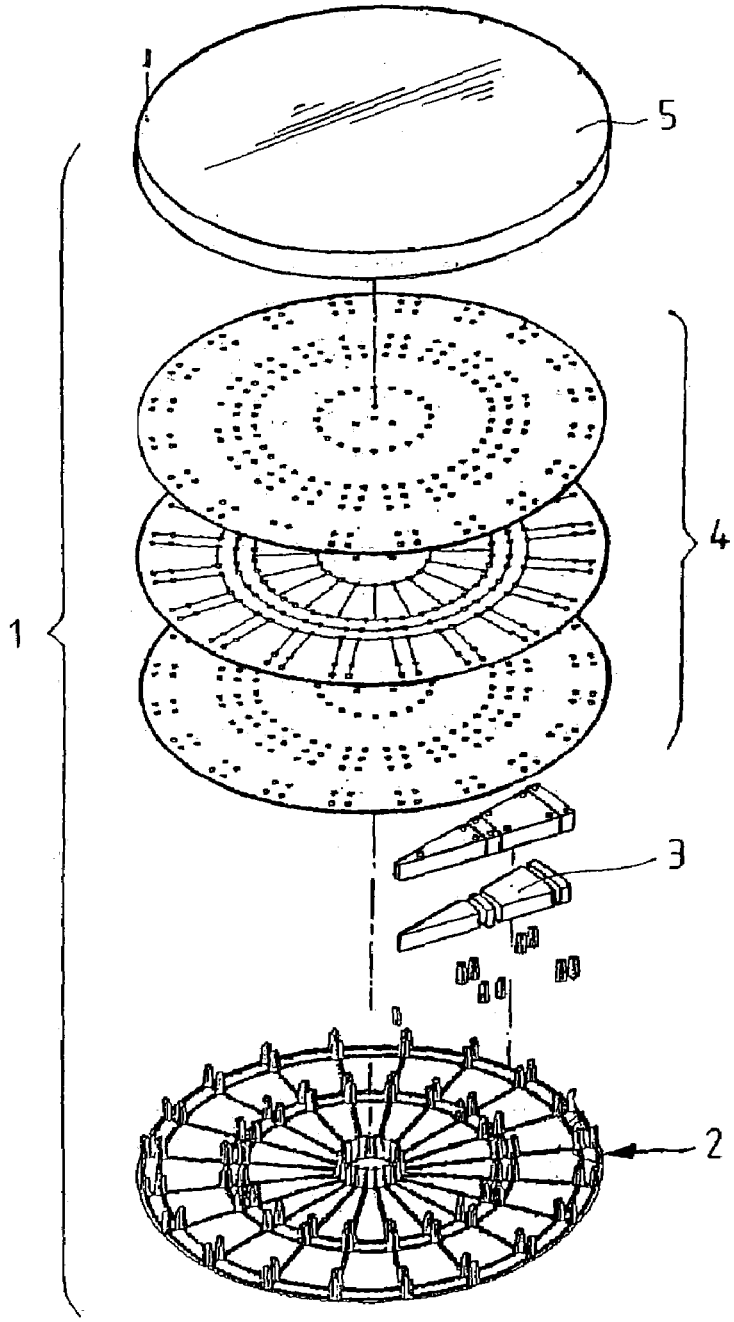
F I G . 1 PRIOR ART
FIG. 1 shows an exploded view of an electronic dartboard of the prior art.
Figure 2:
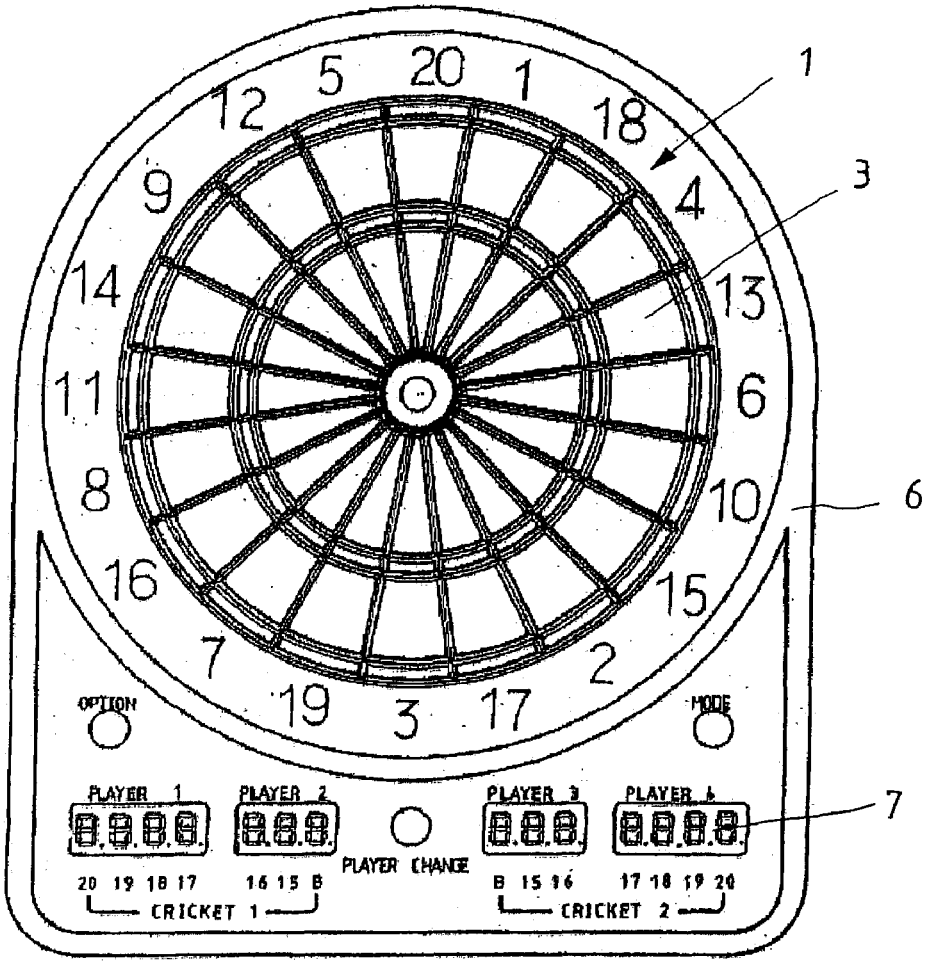
F I G . 2 PRIOR ART
FIG. 2 shows a perspective view of the prior art electronic dartboard in combination.
Figure 3:
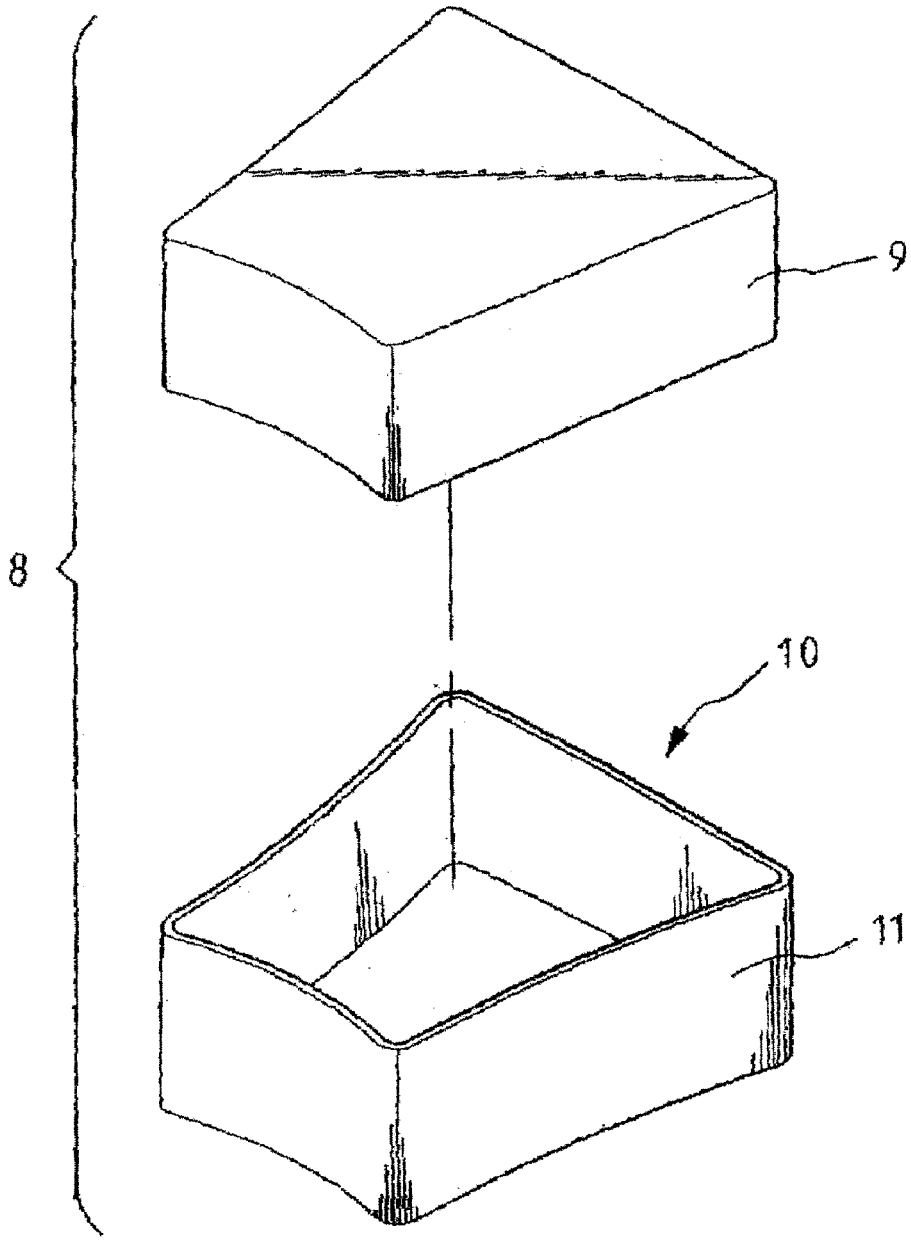
F I G . 3 PRIOR ART
FIG. 3 shows an exploded view of a device disclosed in the Taiwan Patent Serial Number 89222453.
Figure 4:
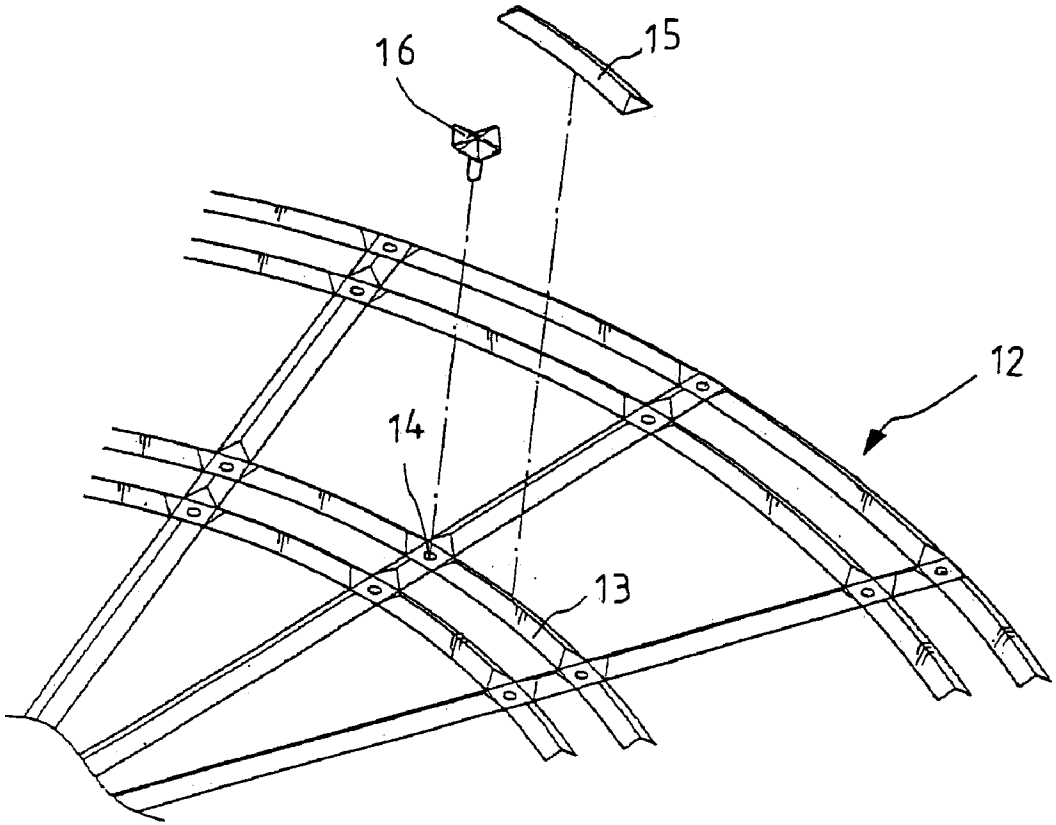
FIG. 4 PRIOR ART
FIG. 4 shows an exploded view of a device disclosed in the Taiwan Patent Serial Number 90221325.
Figure 5:
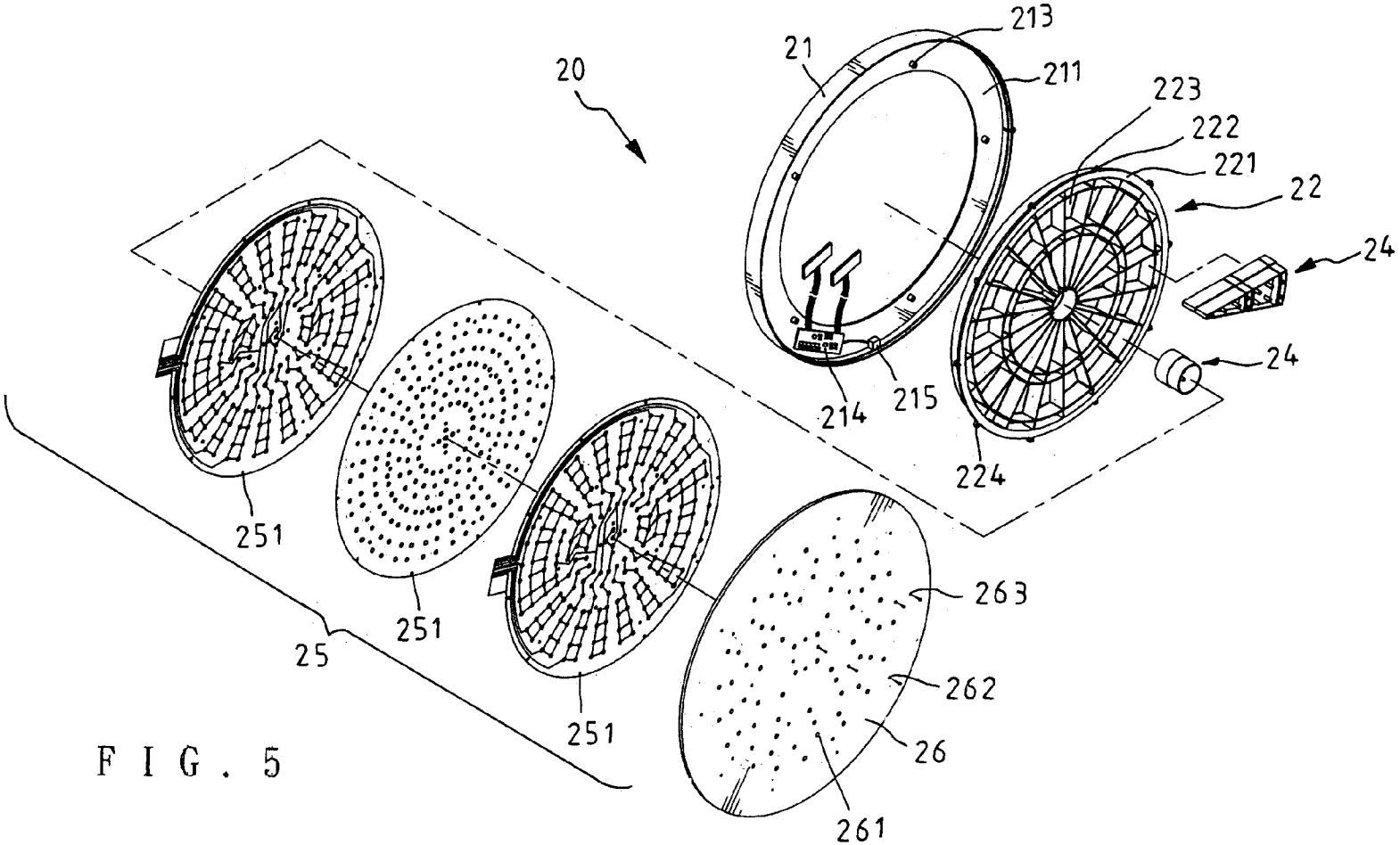
FIG. 5 shows an exploded view of an electronic dartboard of the present invention.
Figure 6C:
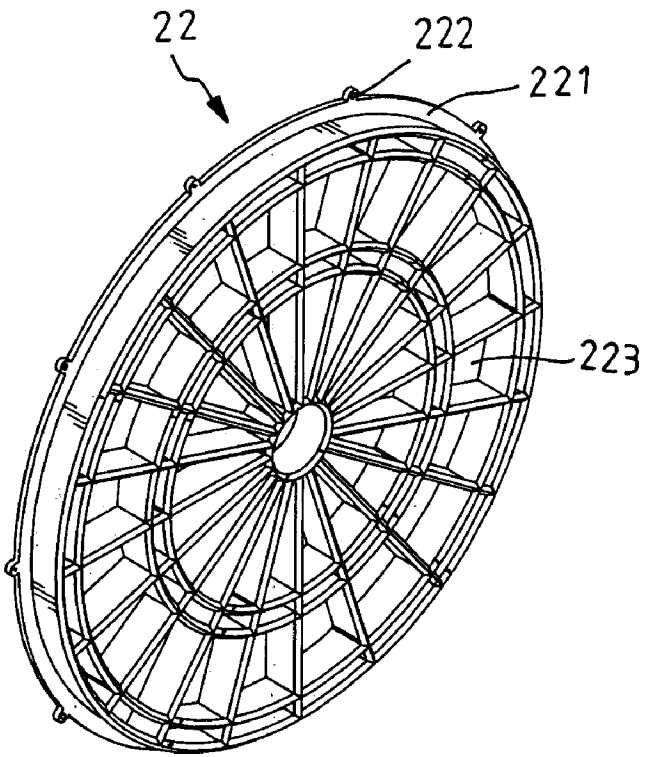
FIG. 6C shows a front schematic view of the dartboard frame of the present invention.
Figure 6A:
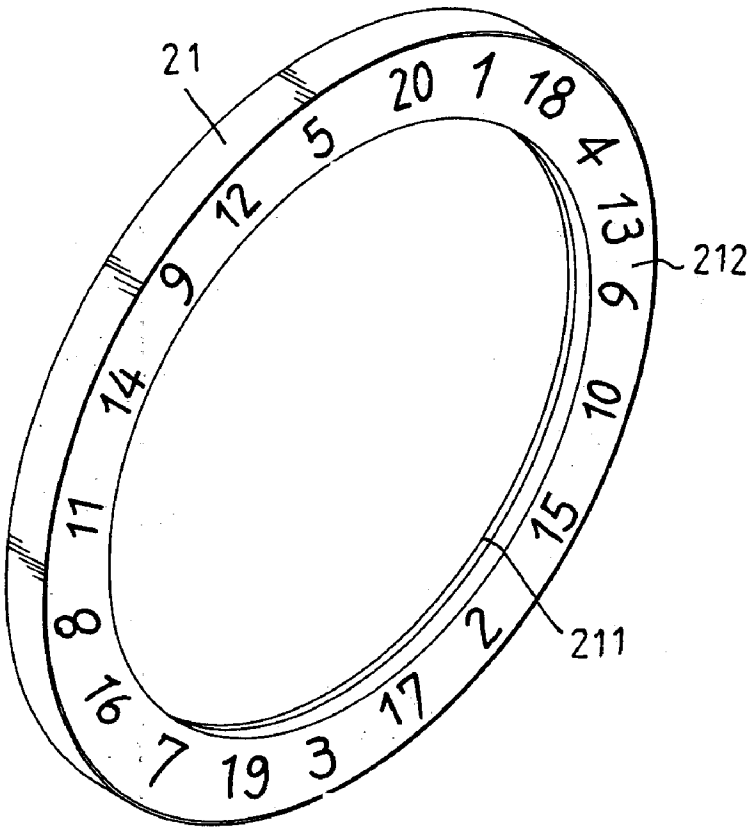
FIG. 6A shows a front view of an outer frame of the present invention.
Figure 6B:
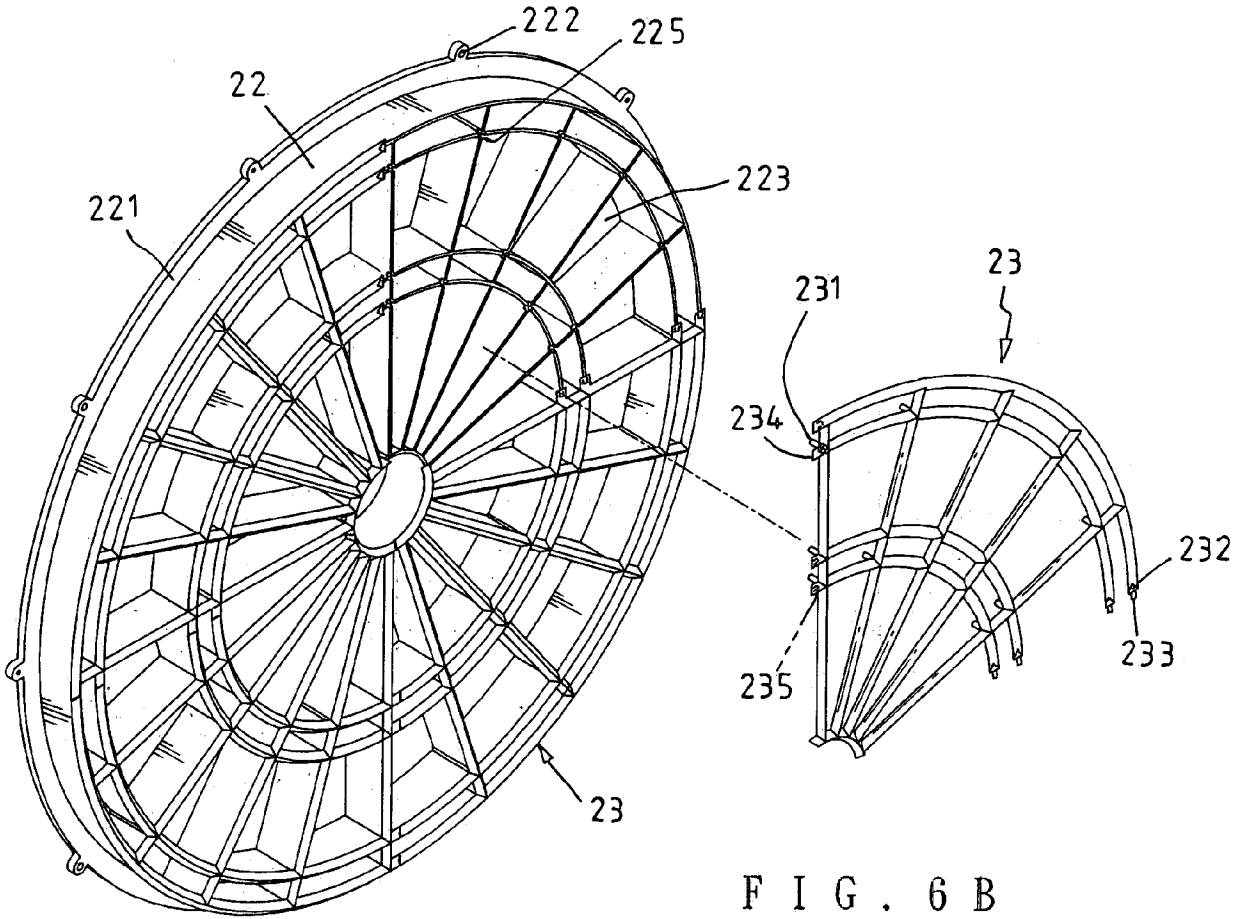
FIG. 6B shows a schematic view of assembly of the dartboard frame and the protective frame of the present invention.
Figure 6D:
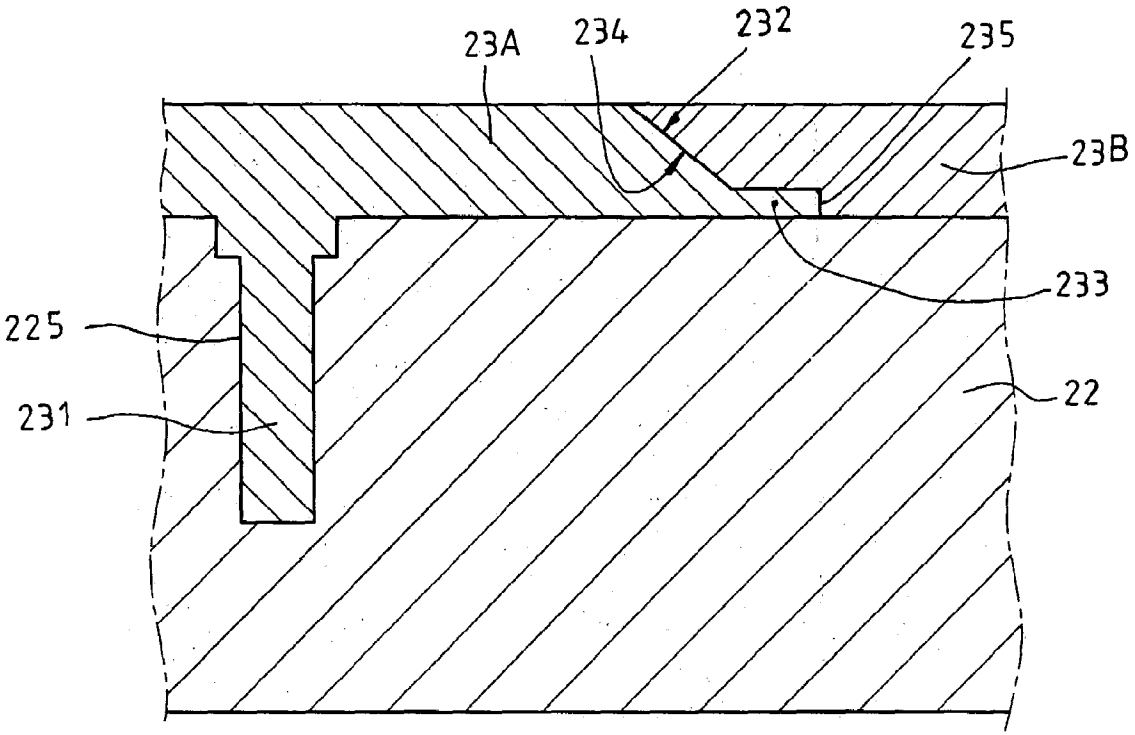
FIG. 6D shows a partial sectional view of the dartboard frame and the protective frame of the present invention.
Figure 6E:
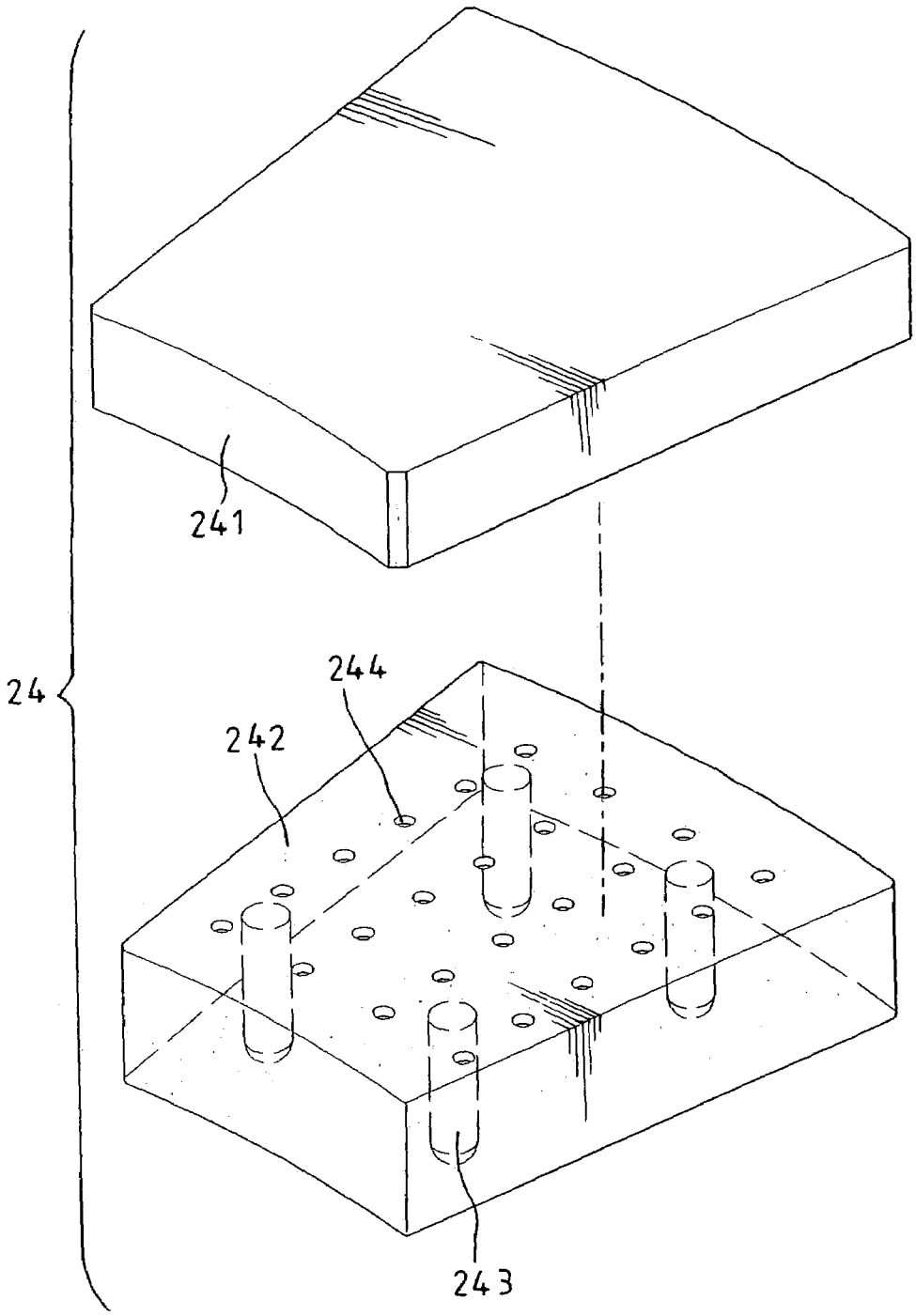
FIG. 6E shows a schematic view of the dartboard block of the present invention.
Figure 7:
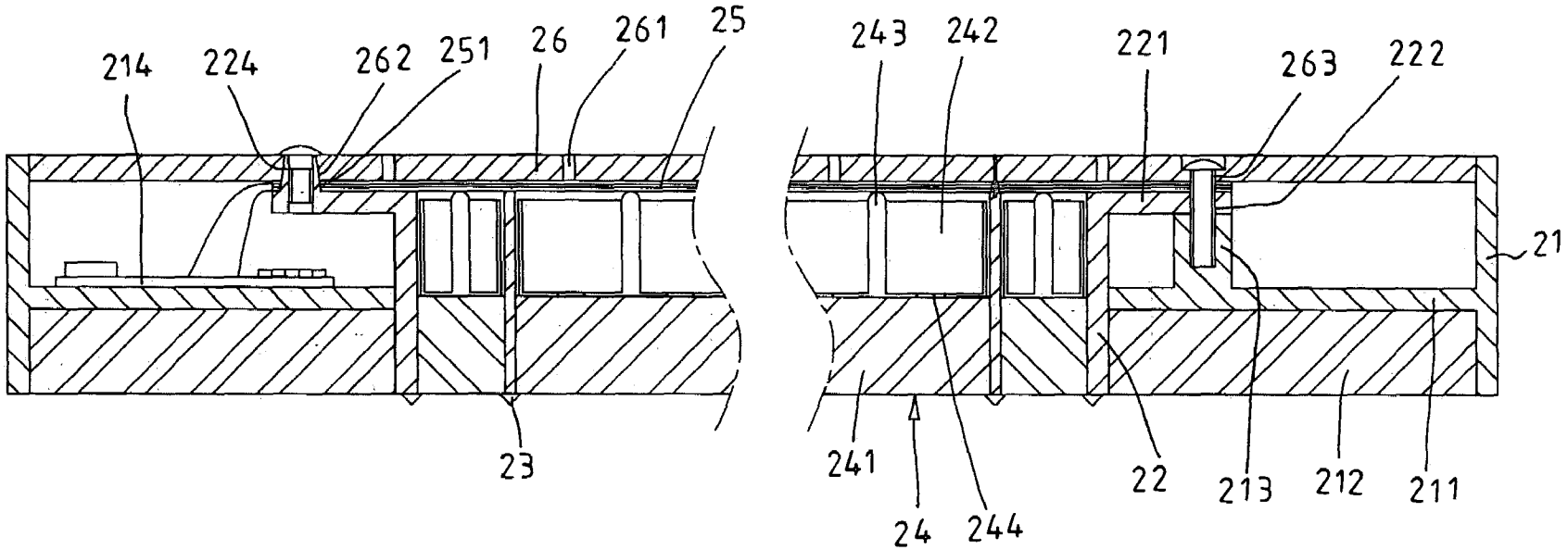
FIG. 7 shows a sectional schematic view of assembly of the dartboard of the present invention.
Figure 8:
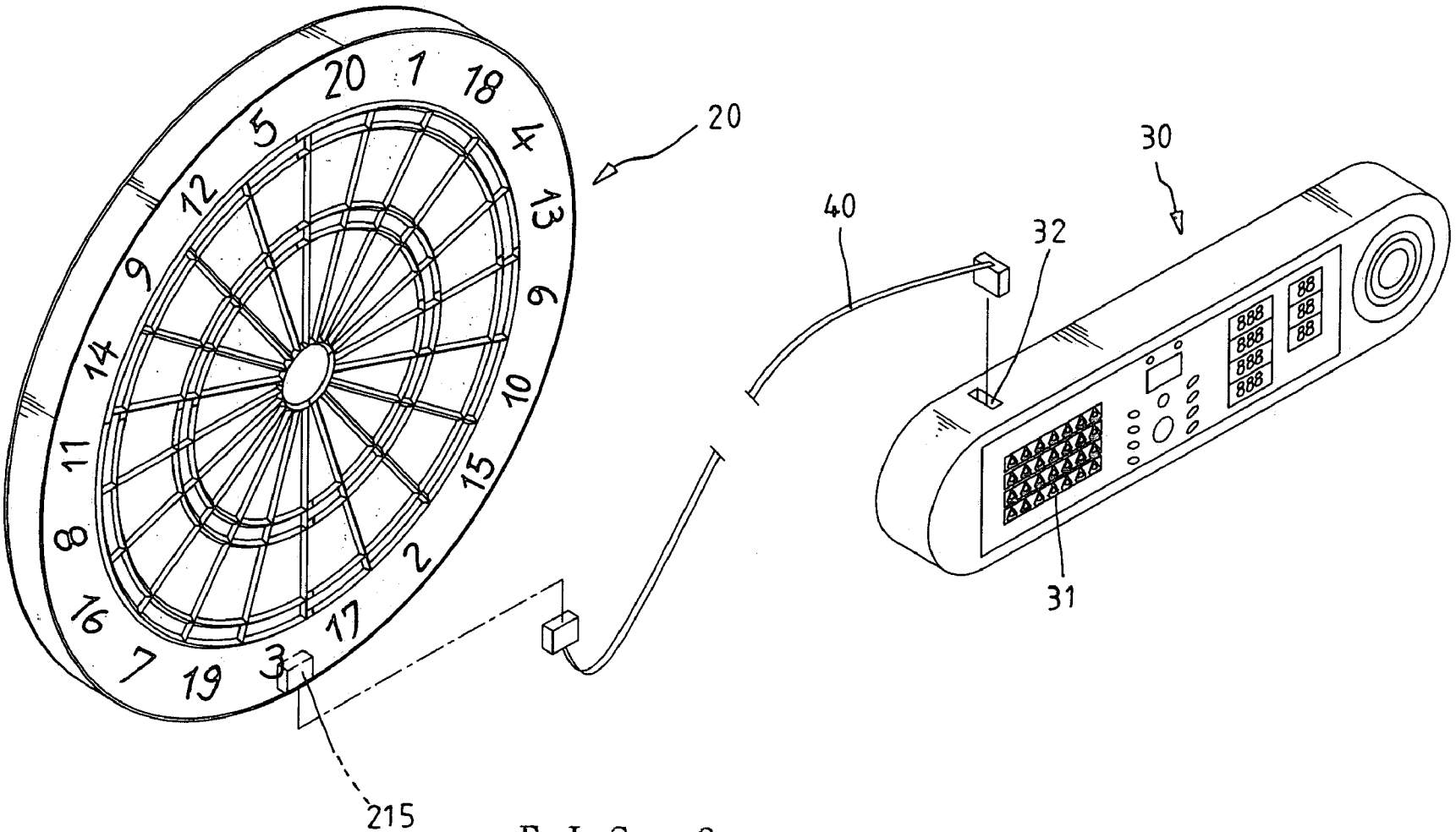
FIG. 8 shows a schematic view of the dartboard and the score display of the present invention.
Figure 8A:
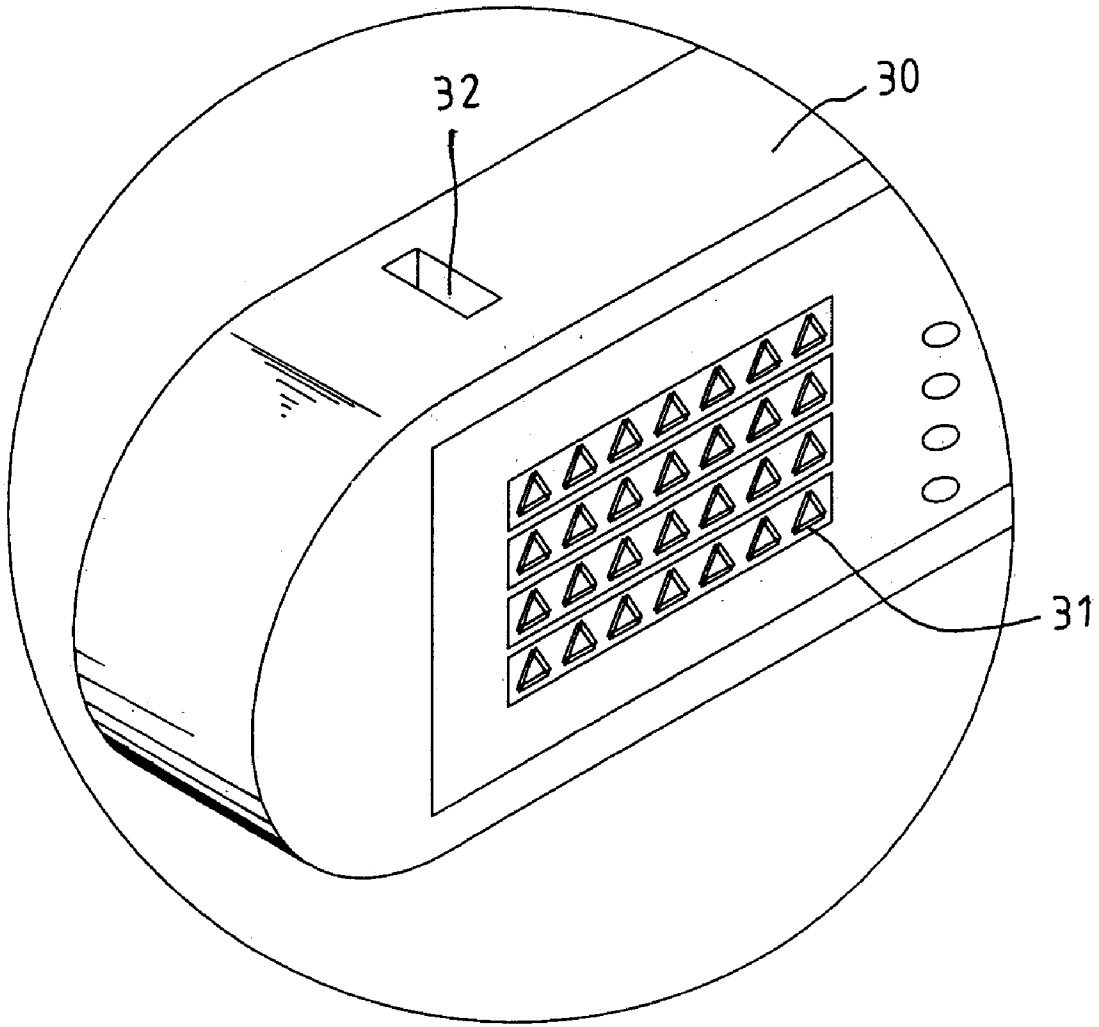
FIG. 8A shows a partial enlarged view of the score display of the present invention.

As shown in FIGS. 5–8A, a dartboard 20 embodied in the present invention comprises an outer frame 21 which is provided with a partition 211 and a score board 212 located in front of the partition 211. The partition 211 is provided in the back with tenons 213 and a circuit board 214 having an insertion portion 215. The circuit board 214 is provided with a power outage memory register for keeping the score data in the event of the power outage. As the power service is resumed, the latest score data are kept in the memory while the old score data are deleted. A dartboard frame 22 is provided in an outer protruding edge 221 with a plurality of through holes 222 corresponding to the tenons 213 of the outer frame 21, and a plurality of receiving spaces 223. The outer protruded edge 221 is provided with a plurality of locating projections 224. The dartboard frame 22 is provided at the juncture of the ribs with an insertion hole 225. A plurality of protective frames 23 are provided with a locating projection 231 of a stepped construction and corresponding to the insertion hole 225 of the dartboard frame 22. The protective, frames 23 are provided with an outer, inclined surface 232 and a protruded portion 233. The protective frames 23 are further provided with an inner inclined surface 234 and a slot 235. The locating projection 231 of the protective frame 23A is inserted into the insertion hole 225 of the dartboard frame 22 such that the outer inclined surface 232, the protruded portion 233, the inner inclined surface 234, and the slot 235 are fastened in a lap-joint manner with an adjoining protective frame 23B. The inner inclined surface 234 and the outer inclined surface 232 are capable of an up-and-down displacement. The locating projection 231 is capable of a left-right displacement. A plurality of dartboard blocks 24 are disposed in the receiving spaces 223 of the dartboard frame 22. The dartboard blocks 24 are formed of a dartboard body 241 and a mounting seat 242. The dartboard body 241 is integrally made of a composite material and is provided with a plurality of sides corresponding to inner sides of the dartboard frame 22. The mounting seat 242 is integrally made of a plastic material and is provided with a plurality of press rods 243, and silencing holes 244. The mounting seat 242 is slightly smaller in size than the dartboard body 241. In the assembly of the dartboard blocks 24, the dartboard body 241 is first inserted into the dartboard frame 22 such that the dartboard body 241 is capable of a microdisplacement. The mounting seat 242 is disposed inside the dartboard frame 22 such that the mounting seat 242 is capable of sliding. An induction circuit film set 25 is provided with a plurality of holes 251 corresponding to the through holes 222 and the locating projections 224 of the dartboard frame 22. The induction circuit film set 25 is disposed on the dartboard frame 22 such that the locating projections 224 are inserted into the holes 251, and that the induction circuit film set 25 is connected to the circuit board 214. A cover plate 26 is provided with a plurality of silencing holes 261, and a plurality of holes 262 and 263 corresponding to the locating projections 224 and the through holes 222 of the dartboard frame 22, thereby facilitating the fastening of the cover plate 26 with the dartboard frame 22. The cover plate 26 is further provided with a hole 263 by means of which the cover plate 26 is fastened with the outer frame 21 in conjunction with a fastening bolt which is fastened onto the tenon 213 of the outer frame 21 via the hole 263. A score display 30 is provided such that it is separated from the dartboard 20. The score display 30 is formed of a plurality of light-emitting diodes 31 arranged in a triangular formation, and an insertion portion 32 for receiving one end of a transmission line 40 by which the score display 30 is connected to the dartboard 20 such that other end of the transmission line 40 is connected to the insertion portion 215 of the circuit board 214 of the outer frame 21. The score display 30 is separated from the dartboard 20 and is therefore not vulnerable to damage which is caused by a misfired dart. In light of the circuit board 214 being provided with an outage memory register, the score data are kept in the memory in case of a power outage. As the power service is resumed, the latest score data are kept in the memory, with the old data being deleted.

Figure 9:
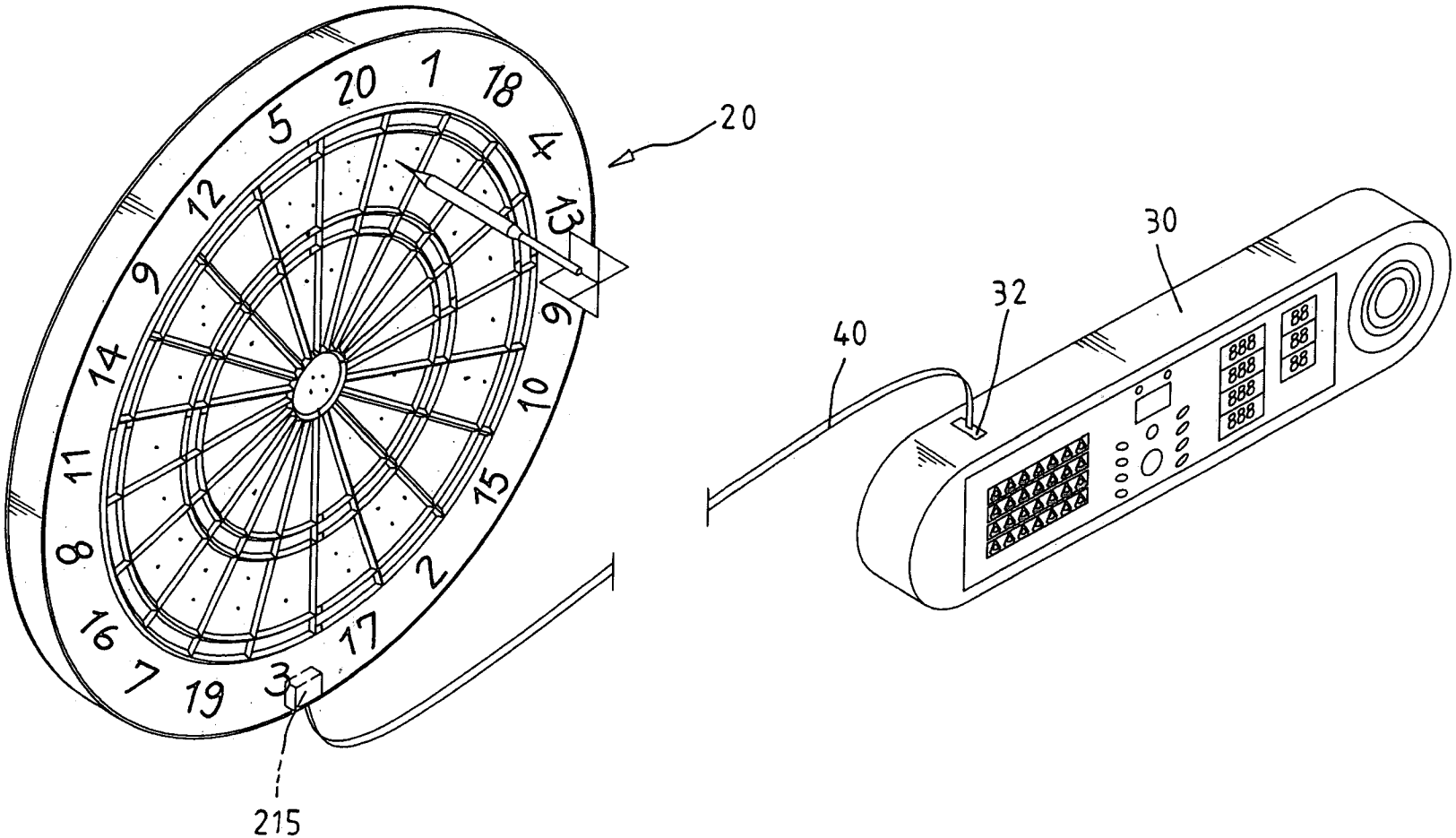
FIG. 9 shows a schematic view of the present invention at work.
Figure 10:
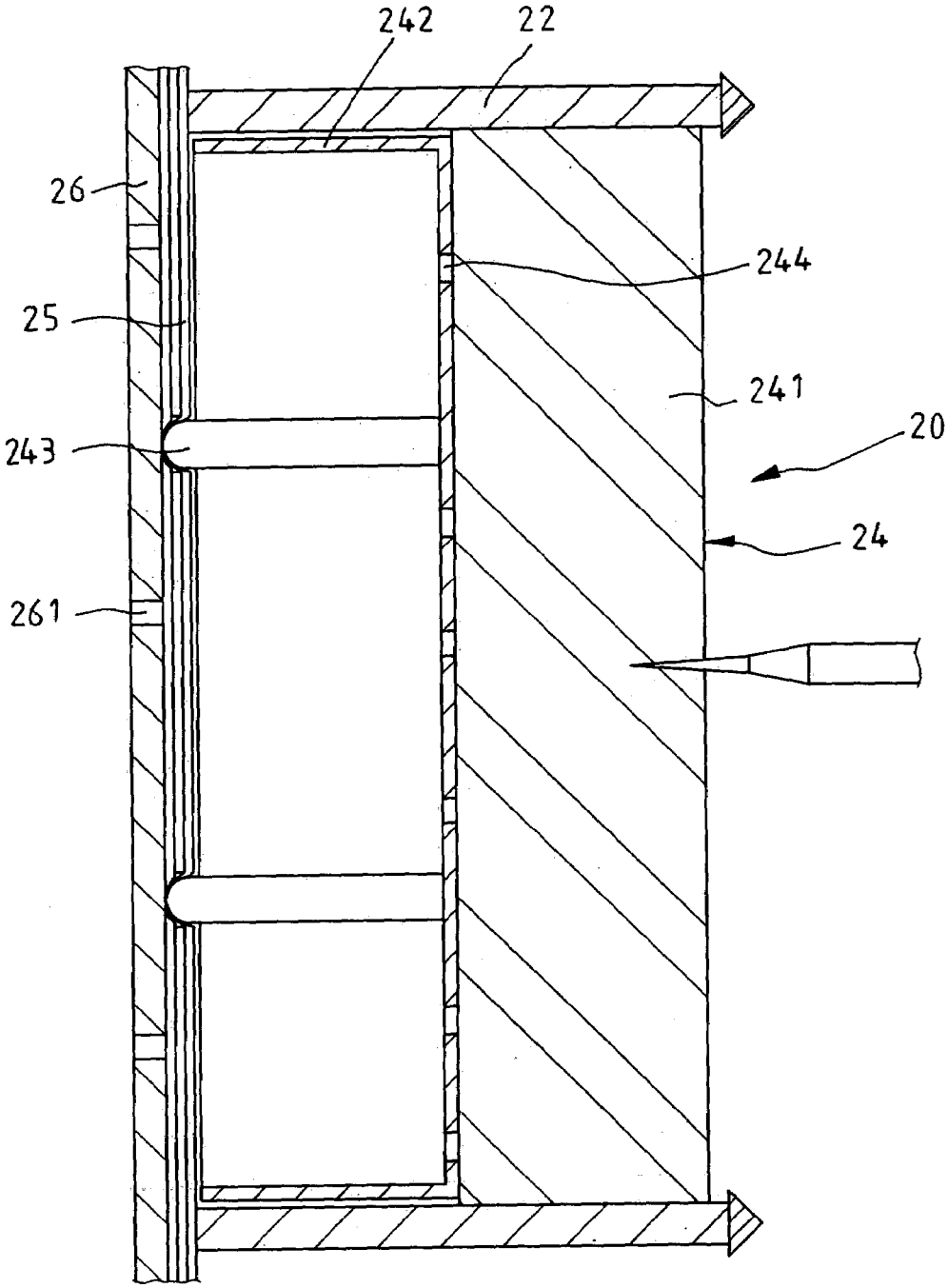
FIG. 10 shows a schematic view of the displacement of the dartboard block of the present invention.

As illustrated in FIGS. 9 and 10, the electronic dartboard 20 of the present invention is used along with a metal dart. In light of the dartboard body 241 of the dartboard blocks 24 being associated with the dartboard frame 22 with an appropriate tightness such that the dartboard body 241 is separated from the inner wall of the dartboard frame 22 by a microdistance which is capable of preventing the metal dart from being caught. As the dartboard block 24 is hit by the metal dart, the dartboard body 241 is impacted to displace inward to cause the mounting seat 242 to vibrate. As a result, the press rods 243 of the mounting seat 242 come in contact with the induction circuit film set 25, so as to effect the scoring. The cover plate 26 is located behind the induction circuit film set 25 to provide a reaction force by which the mounting seat 242 and the dartboard body 241 are caused to move outward to return to their original positions. Accordingly, the induction circuit film set 25 is capable of returning to its initial state to remain in a standby manner.

At the time when the dartboard block 24 is hit by the metal dart, a noise is generated as a result of the collision between the dartboard body 241 and the mounting seat 242, as well as the collision between the press rods 243 of the mounting seat 242 and the cover plate 26. In order to silence the noise, the mounting seat 242 is provided with a number of silencing holes 244. Meanwhile, the cover plate 26 is also provided with a number of silencing holes 261. As a result, the electronic dartboard 20 of the present invention is relatively quiet while in operation.

Figure 11:
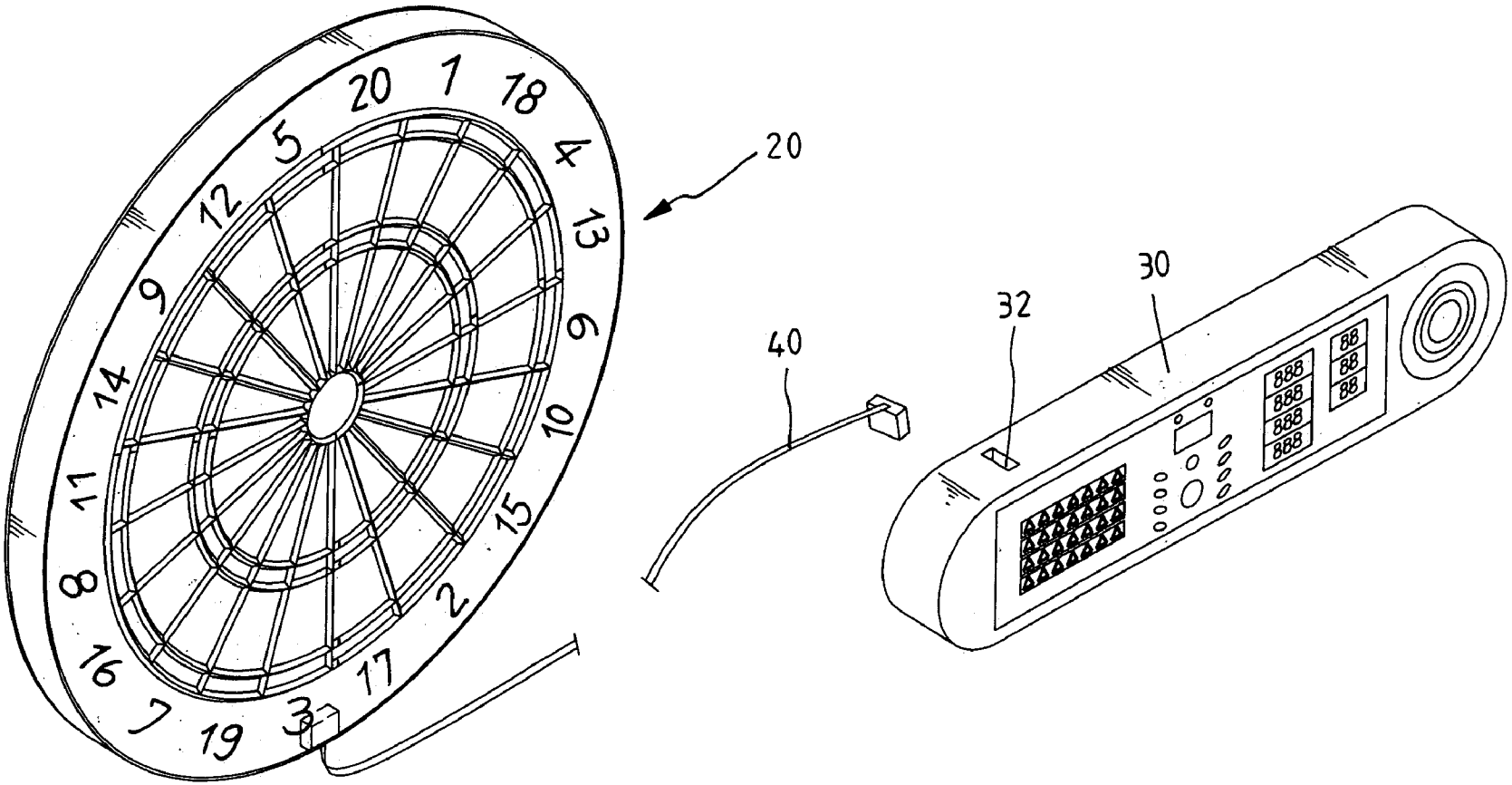
FIG. 11 shows a schematic view of the replacing of a damaged item of the present invention.

As shown in FIG. 11, the electronic dartboard 20 is connected to the score display 30 by the transmission line 40. In the event that the display 30 is damaged or out of order the display 30 is easily separated from the dartboard 20 by unplugging the transmission line 40.

The embodiment of the present invention described above is to be regarded in all respects as being illustrative and nonrestrictive. Accordingly, the present invention may be embodied in other specific forms without deviating from the spirit thereof. The present invention is therefore to be limited only by the scopes of the following claims.

What is claimed is:

1. An electronic dartboard comprising:

an outer frame provided with a score board and a circuit board;

a dartboard frame mounted in said outer frame and provided with a plurality of receiving spaces and a plurality of insertion holes;

a plurality of dartboard blocks disposed in said receiving spaces of said dartboard frame, each of said dartboard blocks being formed of a dartboard body and a mounting seat, with said dartboard body being disposed on top of said mounting seat such that said dartboard body is separated from said mounting seat by a microdistance, said dartboard body being provided therebehind with a mounting seat having a plurality of press rods and capable of sliding in relation to said dartboard frame;

a plurality of protective frames, each being provided with a plurality of locating projections corresponding to said insertion holes of said dartboard frame, a protruded portion, and a slot whereby said protective frames are joined with said dartboard frame such that said locating projections are received in said insertion holes of said dartboard frame;

an induction circuit film set located behind said dartboard frame and connected to said circuit board of said outer frame;

a cover plate fastened with said outer frame and provided with a plurality of silencing holes; and a score display separably connected to said circuit board of said outer frame by a transmission line.

2. The electronic dartboard as defined in claim 1, wherein said protective frames are provided in one connection portion with an outer inclined surface and a protruded portion, and in other connection portion with an inner inclined surface and a slot whereby said inner inclined surface and said slot of one of said protective frames are joined with said outer inclined surface and said protruded portion of another one of said protective frames in a lap-joint manner.

3. The electronic dartboard as defined in claim 1, wherein said dartboard frame is provided with an outer protruded edge having a plurality of locating tenons; wherein said cover plate is provided with a plurality of bolt holes corresponding to said locating tenons of said dartboard frame.

4. The electronic dartboard as defined in claim 1, wherein said score display is provided with a plurality of light-emitting diodes which are triangularly arranged.

5. The electronic dartboard as defined in claim 1, wherein said outer frame is provided with a partition which is provided with a plurality of tenons; wherein said dartboard frame is provided with a plurality of through holes corresponding to said tenons for receiving bolts by which said outer frame, said dartboard frame and said cover plate are fastened together.

6. The electronic dartboard as defined in claim 1, wherein said cover plate is provided with a plurality of bolt holes; wherein said outer frame is provided with a plurality of locating projections corresponding to said bolt holes.

7. The electronic dartboard as defined in claim 1, wherein said mounting seat of said dartboard blocks is provided in a top plate with a plurality of silencing holes.

* * * * *